US007301130B2

(12) United States Patent
Mills

(10) Patent No.: US 7,301,130 B2
(45) Date of Patent: Nov. 27, 2007

(54) OVEN SYSTEM WITH AUTOMATED MESSAGES

(75) Inventor: Nigel G. Mills, Kettering, OH (US)

(73) Assignee: Premark FEG LLC, Wilmington, DE (US)

( * ) Notice: Subject to any disclaimer, the term of this patent is extended or adjusted under 35 U.S.C. 154(b) by 0 days.

(21) Appl. No.: 11/481,768

(22) Filed: Jul. 6, 2006

(65) Prior Publication Data

US 2006/0249503 A1 Nov. 9, 2006

Related U.S. Application Data

(63) Continuation of application No. 10/918,637, filed on Aug. 13, 2004, now Pat. No. 7,094,995.

(51) Int. Cl.
*H05B 1/02* (2006.01)

(52) U.S. Cl. ..... 219/506; 219/714; 219/494; 340/692; 700/300

(58) Field of Classification Search ..... 219/492, 219/494, 497, 506, 702, 714; 340/384.5, 340/692, 384.71; 700/90, 300; 99/325–333; 348/61, 156, 135
See application file for complete search history.

(56) References Cited

U.S. PATENT DOCUMENTS

| | | | |
|---|---|---|---|
| 4,343,990 | A | 8/1982 | Ueda |
| 5,186,097 | A | 2/1993 | Vaseloff et al. |
| 6,559,882 | B1 | 5/2003 | Kerchner |
| 6,949,729 | B1 | 9/2005 | Ishikawa |

*Primary Examiner*—Mark Paschall
(74) *Attorney, Agent, or Firm*—Thompson Hine LLP

(57) ABSTRACT

In an in-store oven system audible customer messages are automatically generated based upon a food product cooked in an oven within the store.

16 Claims, 2 Drawing Sheets

OVEN SYSTEM WITH AUTOMATED MESSAGES

CROSS-REFERENCE TO RELATED APPLICATION

This application is a continuation of application Ser. No. 10/918,637, filed Aug. 13, 2004 now U.S. Pat. No. 7,094,995.

TECHNICAL FIELD

The present application relates generally to commercial ovens used to cook food products in groceries and supermarkets, and more particularly to an in-store oven system with an automated customer notification function.

BACKGROUND

Ovens, such as rack ovens, are commonly used in groceries and supermarkets to produce fresh baked goods for sale to customers. Other types of ovens, such as rotisserie ovens in the meat department, are used to cook food products such as whole chickens for sale to customers. Attracting customers to the bakery section or meat section when product is most fresh would be desired to increase sales.

SUMMARY

In one aspect, an automated method of marketing food products in a store involves automatically identifying completion of a cooking cycle for a specific food product; and automatically outputting an audible customer message in the store, the audible customer message corresponding to the specific food product and advising customers of the availability of the specific food product in a section of the store.

DETAILED DESCRIPTION

Figure 1:
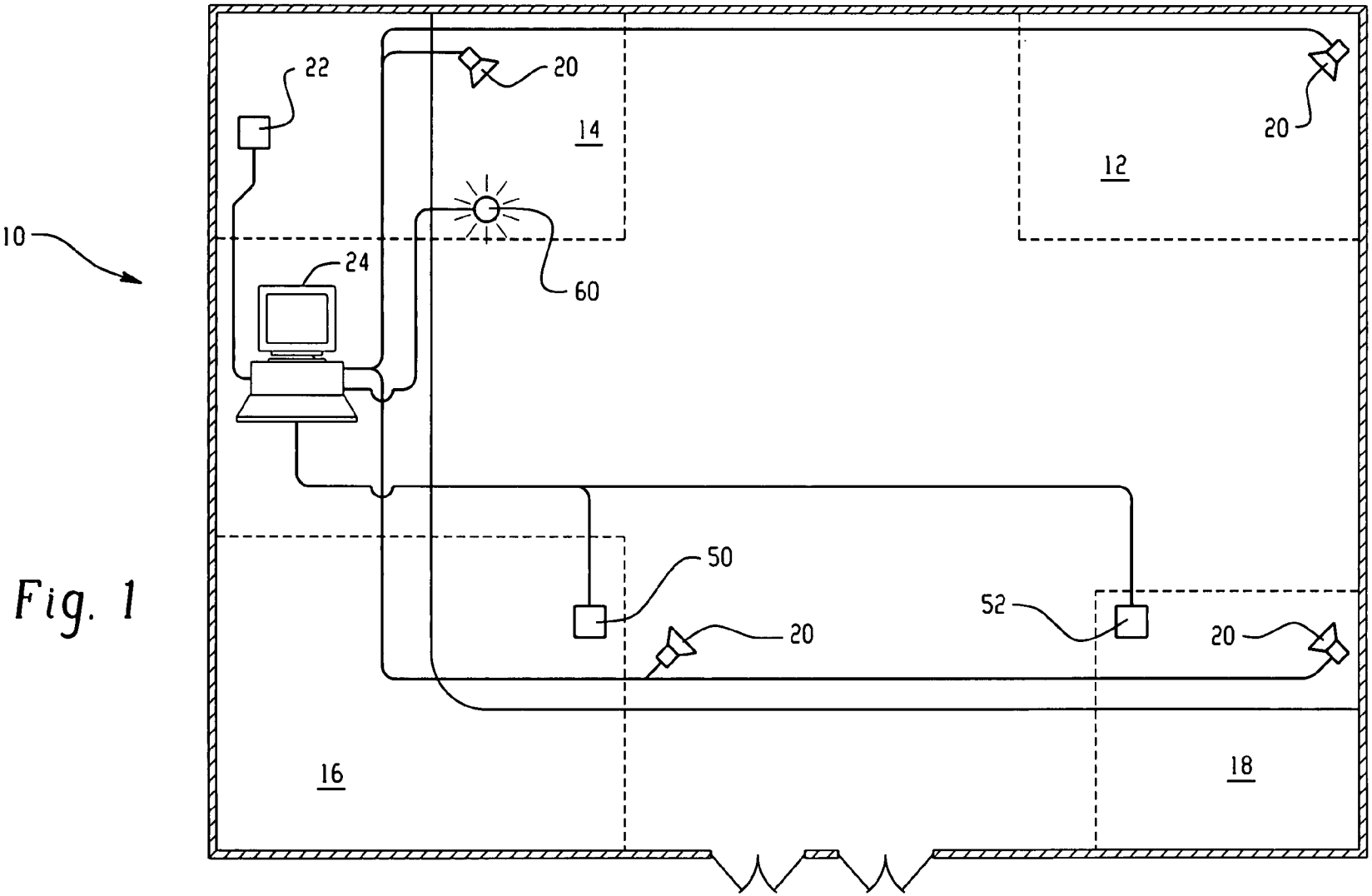
FIG. 1 is an exemplary store layout.

Referring to FIG. 1 an exemplary supermarket layout 10, includes a fruit & vegetable department 12, a bakery department 14, a meat and fish department 16 and a deli department 18. Also shown is an exemplary in-store audio system including speakers 20, which the store can use for store personnel needs and can also use to convey audio messages to customers in the store. In a back-room area of the bakery department 14, a rack oven 22 is illustrated. Rack ovens of various forms are known, such as those described in U.S. Pat. No. 5,617,839. The rack oven 16 may be used to produce fresh baked goods (such as rolls and bread) for sale by the store.

In the illustrated system, the oven is connected with a remotely located computer, such as in-store PC 24, for providing production status information to the PC 24. The PC forms part of the in-store audio system to enable the PC to effect the output of audio messages via the speakers 20. Utilizing this basic system, automated customer merchandising messages can be generated based upon the production status of fresh baked goods. For example, in one embodiment when the oven has completed baking of a product, a signal is sent to the PC 24 and the PC responsively effects output of an audio message such as "fresh baked italian bread now available in the bakery section" or "pick up warm croissant rolls, ready for your sandwiches, fresh from the bakery and receive a coupon for deli meats from our world class deli department." Thus, the automated message can convey not only fresh baked goods availability, but additional merchandising messages, such as coupon or other incentive messages.

Figure 2:
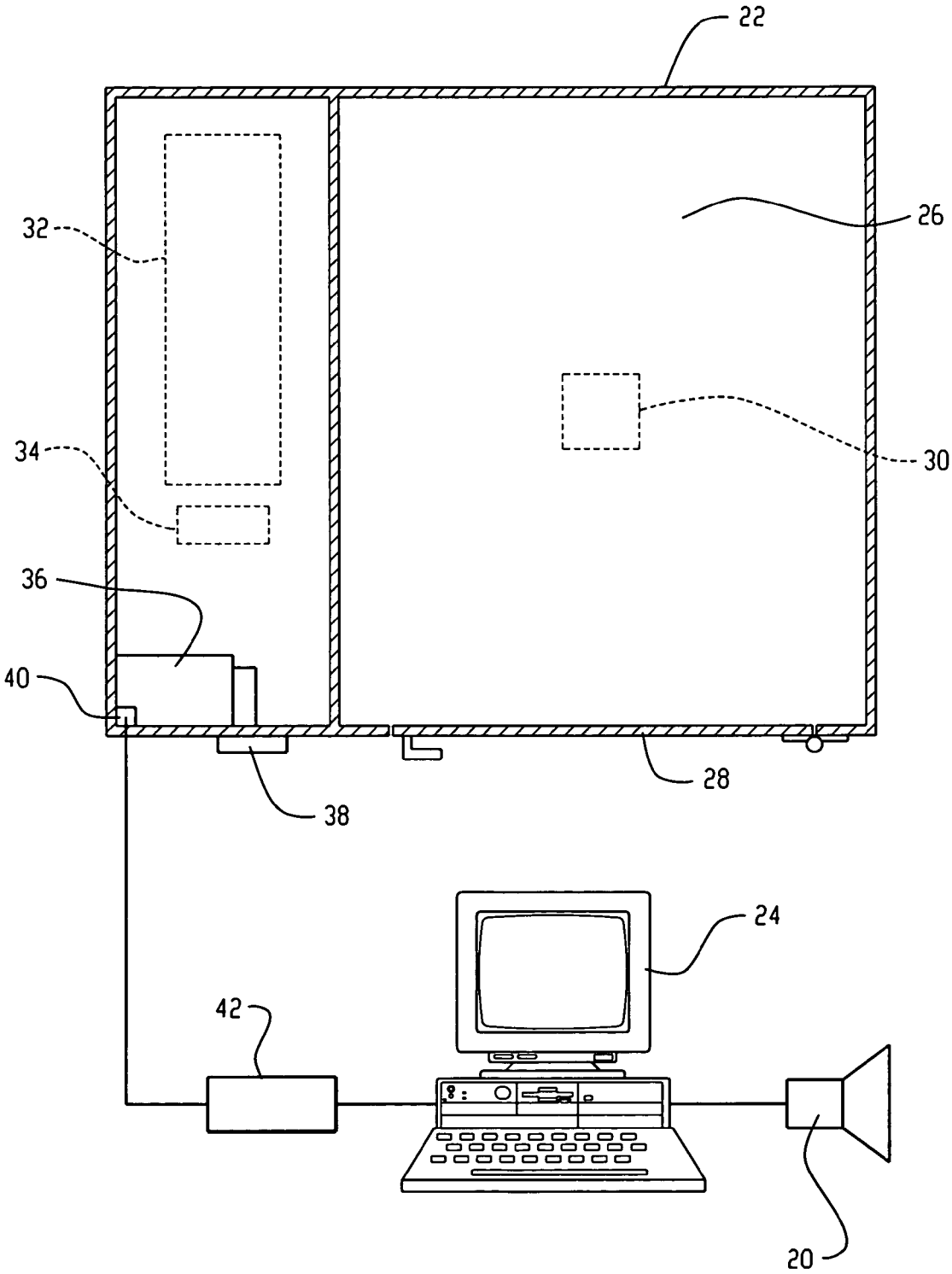
FIG. 2 illustrates one embodiment of an oven system automated messaging architecture.

Referring now to FIG. 2, the oven 22 includes a baking chamber 26 with associated access door 28 and overhead rack rotating mechanism 30, a heat exchanger 32, such as heat exchange tubes, with associated gas burner system 34. A controller 36 controls operation of the oven 22 and includes a connection with a user interface 38 that allows operators to initiate certain baking cycles of the oven 22. For example, the controller may store a plurality of baking cycles or recipes (e.g, each including time and temperature) for a corresponding plurality of baked goods. The controller 36 outputs low level electronic signals (flags) indicating production status from a communications port 40 (which in one example may be an RS-485 Serial Port). The flags are received by a protocol converting Gateway 42 (in one example a Control Products GW-5210) that outputs the flags as SNMP (simple network management protocol) objects over a network to which a remote (typically elsewhere in the store) device is connected. The device can be configured to play sound files (stored in memory of the device) based upon the status of the flags output by the oven 22. For example, Internet enabled PC 24 can be configured to run an application programmed to play a sound file, or the sound card of the PC 24 can be connected to or form part of the public address system of the store to play the sound file storewide via speakers 20.

Typical flags output by the oven 22 might include a "recipe running" flag that identifies the recipe number currently being run by the oven, where different food products have different recipes and the recipes represent different cooking cycles for the food products (e.g., 00=rolls, 01=croissants, 10=Italian bread, 11=French bread, etc.), and a "cycle completion" flag that is output when the recipe is completed. The PC retrieves a sound file based upon the recipe number and causes the sound file to be output as an audio message.

In one embodiment the PC 24 may regularly poll the oven for recipe running and status information. For example, every 5-10 seconds the PC 24 polls the oven for the information and the oven responsively provides it. While a cooking cycle in running the oven provides the recipe number and status indicator of "cycle running." When the status response from the oven changes from "cycle running" to "cycle done," the PC 24 determines that the oven has just completed its cooking cycle and audio message function is triggered accordingly. Thus, as used herein the term "cooking cycle completion" or "completion of a cooking cycle" encompasses the PC's internal determination that the cooking cycle is over even if that internal determination does not coincide to the exact instant in time when the oven actually completes the cooking cycle.

In many instances baked goods (or other cooked food products) cannot be sold immediately due to temperature, texture and moisture considerations, and therefore a typical baked good is not positioned for sale to customers until a certain time period (e.g., about half an hour) after completion of the oven baking cycle. The above-described oven system may therefore be provided with a time delay feature so that the automated audio message coincides with when the baked food product is actually ready for purchase by customers. The delay could be placed at various levels of the electronic architecture shown in FIG. 2. In one approach the delay is built into the application of the PC 24 such that the PC 24 does not output the sound file until a certain time period after the cycle completion flag is received. The delay could vary based upon the recipe number (e.g., longer for recipe numbers associated with more massive food products that take longer to cool), or the delay could be uniform for all products.

It is to be clearly understood that the above description is intended by way of illustration and example only and is not intended to be taken by way of limitation. For example, while the illustrated example assumes that a remote device (such as a PC) includes the sound files for audio messages, it is contemplated that sound files and a sound card could be integrated into an oven controller. Further, while baked goods are primarily described, the messaging system could be implemented in other store departments where other food products are cooked in other types of ovens. For example, a rotisserie oven located in either the meat department or the deli department (see ovens 50 and 52 in FIG. 1 also connected with PC 24) could include a similar automatically generated audio message when a cooking cycle of the oven is completed, such as when roasting of whole chickens is completed. While certain ovens may output a "recipe" flag to the PC 24 as information indicative of the product being cooked, it is recognized that some ovens may only be used to cook one type of food product and that in such instances the network address of the oven itself can form the information indicative of food product being cooked (e.g., when the PC 24 receives a cooking cycle complete indication from an oven the PC 24 can select the appropriate audio message based upon the network address of the oven from which the message is received). Where multiple ovens are connected to the PC 24 for automated generation of audio messages, the PC24 may operate to que audio messages if necessary in order to prevent attempted output of multiple audio messages simultaneously. Similarly, where the PC 24 is used to generate other audio messages in the store, the PC 24 may que the oven-based messages when necessary to avoid interfering with other audio messages. Moreover, while automated audio messages are primarily described above, a visual cue (such as a flashing light 60 in the appropriate section of the store where customers can be attracted by the light) could also be automatically triggered to draw customer attention to the fresh cooked food product. As used herein, the terminology cook, cooked and cooking is intended to broadly encompass operations performed by various types of ovens, including but not limited to baking operations, roasting operations, steaming operations or even microwave operations. Other changes and modifications could be made.

What is claimed is:

1. An oven system located in an establishment, the oven system including automated messaging, the oven system comprising:

an oven including a chamber for cooking food products;

a controller for running a cooking cycle of the oven;

a computer located remotely from the oven, the computer storing at least one sound file, the computer operatively connected with the controller for communication therewith;

at least one speaker in the establishment and remote from the oven, the speaker operatively connected with the computer for outputting an audio message corresponding to the sound file;

wherein based upon communication received from the controller regarding cooking cycle completion, the computer selects the sound file and effects output of the audio message via the speaker.

2. The oven system of claim 1 wherein the computer stores multiple sound files for a corresponding multiplicity of food products, the computer selects an appropriate sound file based upon communication with the controller that provides information indicative of food product being cooked.

3. The oven system of claim 2 wherein the information indicative of food product being cooked is information identifying a specific cooking cycle of the oven.

4. The oven system of claim 2 wherein the computer stores multiple sound files for a corresponding multiplicity of food products, the computer selects an appropriate sound file based upon a network address of the oven.

5. The oven system of claim 2 wherein the audio system includes a delay feature such that the audio customer message is output a certain time period after cooking cycle completion.

6. The oven system of claim 5 wherein the certain time period is dependent upon the food product.

7. The oven system of claim 5 wherein the audio message is a message advising customers of the availability of the food product.

8. The oven system of claim 1 wherein the controller sends both a cooking cycle identifying signal and a cooking cycle complete signal to the audio system.

9. The oven system of claim 1 wherein the computer is a personal computer.

10. An oven system located in an establishment, the oven system including automated messaging, the oven system comprising:

an oven including a chamber for cooking food products;

a controller for running a cooking cycle of the oven;

a computer located remotely from the oven, the computer storing at least one digital file, the computer operatively connected with the controller;

at least one speaker in the establishment and remote from the oven, the speaker operatively connected with the computer for outputting an audio message corresponding to the digital file;

wherein the controller outputs a cooking cycle completion signal to the computer and the computer responsively selects the digital file and effects output of the audio message via the speaker.

11. The oven system of claim 10 wherein the digital file is a sound file storing a customer attracting message.

12. The oven system of claim 10 where the digital file is a sound file storing a message related to a specific food product.

13. The oven system of claim 10 wherein the digital file is one sound file of a plurality of sound files stored on the computer.

14. An oven system located in an establishment, the oven system including automated messaging, the oven system comprising:

an oven including a chamber for cooking food products;

a controller for running a cooking cycle of the oven;

a computer located remotely from the oven, the computer storing at least one file, the computer operatively connected with the controller;

at least one speaker in the establishment and remote from the oven, the speaker operatively connected with the computer for outputting an audio message corresponding to the file;

wherein the controller outputs a signal to the computer and the computer responsively selects the file and effects output of the audio message via the speaker.

15. The oven system of claim 14 wherein the computer stores multiple files each with an associated audio message, the signal output from the controller to the computer is one of a plurality of possible signals, each file is associated with one of the plurality of possible signals, the computer selects an appropriate file based upon the association between files and possible signals.

16. An oven system located in a establishment, the oven system including automated messaging, the oven system comprising:

an oven including a chamber for cooking food products, the oven located in the establishment, the oven including a controller for running a cooking cycle of the oven;

a computer located in the establishment and remote from the oven, the computer storing at least one file, the computer operatively connected with the controller;

at least one speaker in the establishment and remote from the oven, the speaker operatively connected with the computer for outputting an audio message corresponding to the file;

wherein the controller outputs a signal to the computer and the computer responsively selects the file and effects output of the audio message via the speaker.

* * * * *